US006164767A

United States Patent [19]

Nakamura et al.

[11] Patent Number: 6,164,767

[45] Date of Patent: Dec. 26, 2000

[54] INK JET RECORDING APPARATUS HAVING A DRIVING WHEEL MECHANISM FOR PRESSURIZING TUBES OF A TUBE PUMP

[75] Inventors: Masahiro Nakamura; Hayato Nishikaze; Nobuhito Takahashi; Seiji Mochizuki; Kazuhisa Kawakami; Keiichi Ohshima; Satoshi Fujioka, all of Nagano, Japan

[73] Assignee: Seiko Corporation, Tokyo, Japan

[21] Appl. No.: 09/352,941

[22] Filed: Jul. 14, 1999

Related U.S. Application Data

[62] Division of application No. 08/858,575, May 19, 1997, which is a continuation of application No. 08/352,632, Dec. 9, 1994, abandoned.

[30] Foreign Application Priority Data

| | | | |
|---|---|---|---|
| Dec. 10, 1993 | [JP] | Japan | 5-341309 |
| Mar. 14, 1994 | [JP] | Japan | 6-69049 |
| Mar. 31, 1994 | [JP] | Japan | 6-85791 |
| Aug. 12, 1994 | [JP] | Japan | 6-190314 |

[51] Int. Cl.[7] ..... B41J 2/175

[52] U.S. Cl. ..... 347/85

[58] Field of Search ..... 347/85, 30, 84; 417/477.3, 477.7, 474, 475, 477.1

[56] References Cited

U.S. PATENT DOCUMENTS 5,486,854 1/1996 Uchida ..... 347/30

5,828,389 10/1998 Yamaguchi et al. ..... 347/23

*Primary Examiner*—N. Le
*Assistant Examiner*—Michael Nghiem
*Attorney, Agent, or Firm*—Sughrue, Mion, Zinn, Macpeak & Seas, PLLC

[57] ABSTRACT

A tube pump for an ink jet printer includes a driving wheel that is selectively driven in a forward or reverse direction in accordance with the rotation of a drive source. The driving wheel contains two slots that extend symmetrically and radially from the center of the driving wheel. The pump also includes two rollers that are coupled to the drive wheel via roller shafts respectively extending from a radial center of the rollers into the slots. A pressing piece is also provided that forces the shafts into the radially outermost end of the slots to press a tube of the tube pump when said drive wheel rotates in reverse and forces the shafts into the radially innermost end of the slots to not press the tube when said drive wheel rotates in the forward direction. In an alternative arrangement, the tube pump contains a pump chamber, and a tube having an α-like-shaped loop portion is inserted into and disposed along the inner wall of the pump chamber. A driving wheel train is provided, rotated around a shaft of the pump chamber, and has a single roller that cooperates with the inner wall of the pump chamber to press the tube. Also, a guide slot is formed in the driving wheel train to transfer the roller between a tube pressurizing state and a tube nonpressurizing state based on the rotation of the driving wheel train.

2 Claims, 16 Drawing Sheets

INK JET RECORDING APPARATUS HAVING A DRIVING WHEEL MECHANISM FOR PRESSURIZING TUBES OF A TUBE PUMP

This is a divisional of application Ser. No. 08/858,575 filed May 19, 1997, which is a continuation of application Ser. No. 08/352,632 filed Dec. 9, 1994 (now abandoned). Both applications are incorporated herein by reference.

BACKGROUND OF THE INVENTION

1. Field of the Invention

The invention relates to an ink jet printer which has plural ink jet recording heads moving in the width direction of a recording sheet and ejects ink of plural colors in accordance with printing data to print a color image, and also to an ink jet recording apparatus in which plural ink jet recording heads are mounted on the same carriage so as to realize high density printing. More particularly, the invention relates to a capping device which seals an ink jet recording head suitable for such a recording apparatus.

2. Related Art

An on-demand ink jet recording apparatus ejects ink pressurized in a pressurizing chamber from a nozzle as ink drops to a recording sheet, to record printing data on the sheet. Such an apparatus has a problem in that printing failures are caused by increased viscosity of the ink due to evaporation of ink solvent through nozzle openings, the drying of ink, adhesion of dust, introduction of air bubbles, etc. To alleviate this problem, an ink jet recording apparatus is provided with a capping device which seals nozzle openings during a nonprinting period.

Such a capping device is proposed in, for example, Unexamined Japanese Patent Publication No. Hei. 1-125239. In the proposed capping device, a slider is pushed by a carriage returning toward the home position, to be moved toward a nozzle face of a recording head along an inclined guide face which is formed on a frame, and a cap member disposed on the surface of the slider is made to press against and contact with the recording head, thereby sealing nozzles.

Since developments in personal computers allow graphic processing to be executed in a relatively simple manner, a printer which can output a hard copy of a color image displayed on a screen is requested. In view of differences in ink consumption and recording density between colors, and also the prevention of discoloration during a quiescent time, an ink jet printer which can perform such a color printing is so configured that two recording heads, i.e., a recording head for black and white printing and a recording head for color printing, are mounted on one carriage.

Consequently, a capping device must be disposed for each of plural ink jet recording heads, and driving mechanisms for respectively moving the capping devices so as to cover and uncover the recording heads are required. This produces a problem in that the whole structure of the printer is complicated.

SUMMARY OF THE INVENTION

The invention has been conducted in view of these problems. It is an object of the invention to provide a novel ink jet recording apparatus in which the operation of moving plural capping devices so as to cover and uncover the recording heads can be realized by a simple mechanism.

In order to solve the problems, according to the invention, an ink jet recording apparatus comprises: a carriage on which first and second ink jet recording heads each having nozzle openings are mounted; and a slider having first and second cap members which seal the nozzle openings of the first and second ink jet recording heads, respectively, the slider being supported at a center portion in a longitudinal direction by a support member which is rotatable about a rotation shaft elongated in a direction perpendicular to a moving direction of the carriage and which is movable in the moving direction of the carriage, the support member being movable also in a direction opposing the recording heads in accordance with the movement of the slider.

When the carriage is moved under the state where it abuts against the slider, the slider swings about the shaft in a manner similar to a seesaw so that the slider butts against one of the recording heads and then the other recording head. Therefore, two cap members on the same slider can be attached securely to the respective recording heads. Furthermore, the two cap members are moved by moving the single slider in the manner interlocked with the movement of the carriage, and hence the attaching and detaching mechanism for the cap members can be simplified in structure.

DETAILED DESCRIPTION OF THE PREFERRED EMBODIMENTS

The invention will be described in detail in conjunction with illustrated embodiments.

Figure 1:
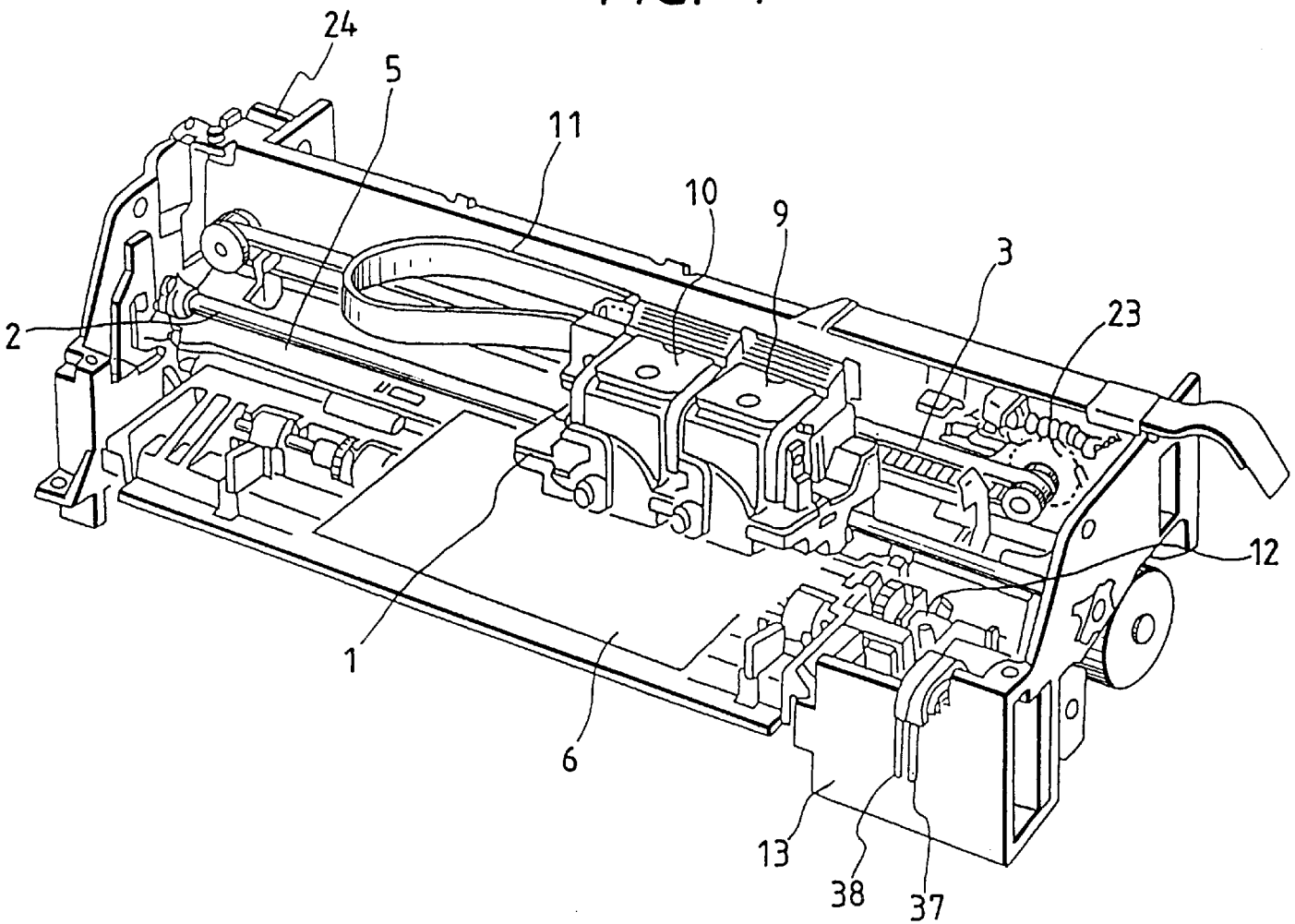
FIG. 1 is a perspective view showing the structure, in the vicinity of a printing mechanism, of an ink jet recording apparatus to which the capping device of the invention is to be applied.

FIG. 1 shows diagrammatically the vicinity of a printing mechanism of an ink jet recording apparatus to which the capping device of the invention is to be applied. In the figure, the reference numeral 1 designates a carriage which is supported by a guide member 2 and coupled with a pulse motor 23 through a timing belt 3 so as to be reciprocally movable in a direction parallel to a platen 5.

A first recording head 7 for black and white printing, and a second recording head 8 for color printing (FIG. 4) are mounted on the carriage 1 in such a manner that nozzle openings are directed to a recording sheet 6. A black ink cartridge 9, and a color ink cartridge 10 are detachably mounted in the upper portions of the recording heads 7 and 8, respectively.

When the recording heads in this configuration receive a drive signal from a head driving circuit (not shown) through a flexible cable 11, ink flows out the ink cartridges 9 and 10 to enter into the recording heads 7 and 8 so that black and colored dots are formed on the recording sheet 6.

Figure 2:
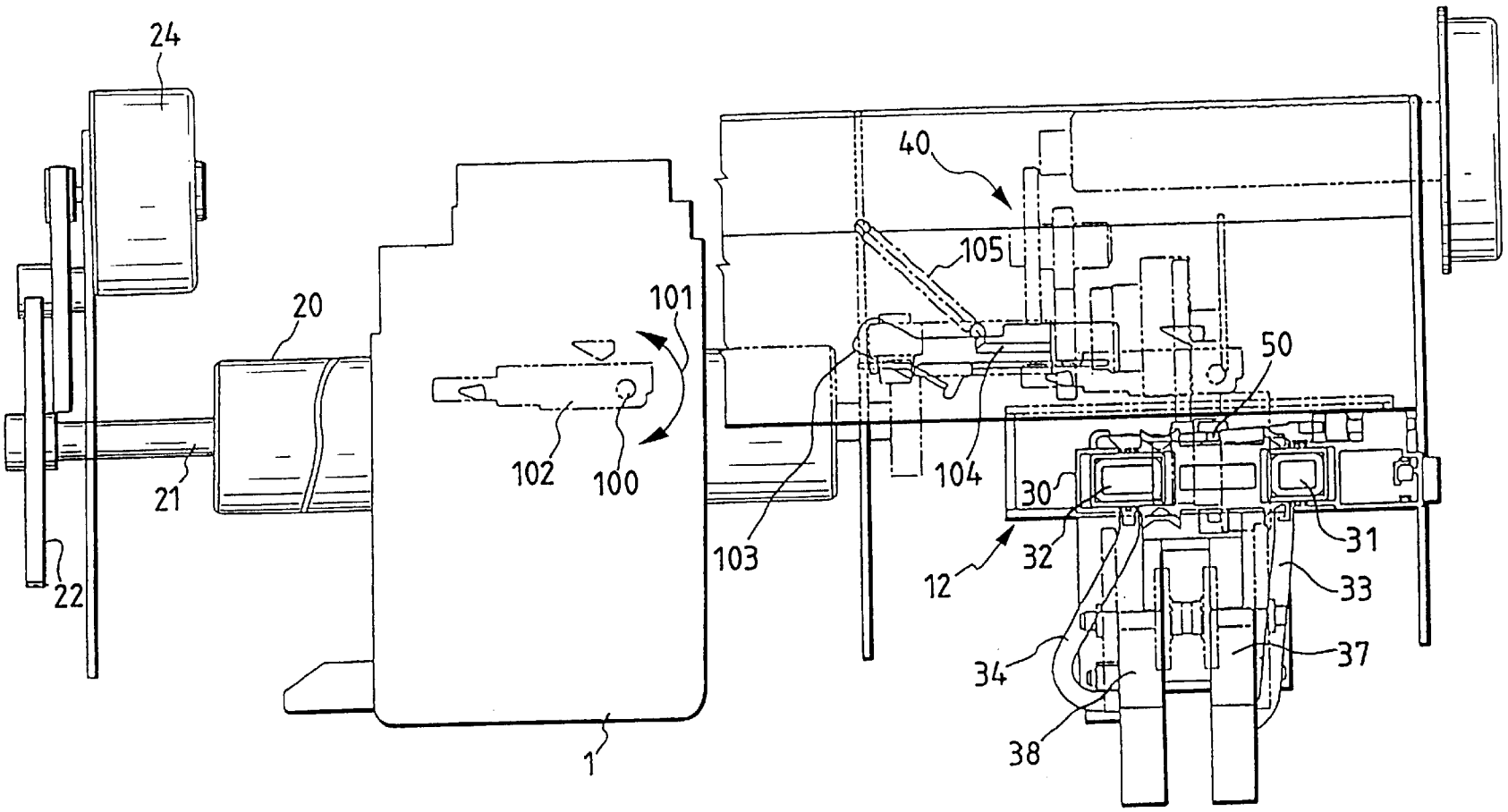
FIG. 2 is a plan view in which the capping device is shown at the center.

FIG. 2 is a diagram showing an upper face in the vicinity of the capping device. In the figure, the reference numeral 20 designates a sheet feed roller.

The sheet feed roller 20 is coupled with a sheet feed and pump motor 24 by a gear 22 which is fixed to one end of a rotation shaft 21, to feed the recording sheet 6 in synchronization with the printing process.

In the figure, the reference numeral 12 designates the above-mentioned capping device which is disposed in the moving path of the carriage 1 outside the printing region. First and second cap members 31 and 32 which are made of an elastic material and have a cup-like shape are disposed on a slider 30. The slider 30 is located in a manner interlocked with the movement of the carriage, at either of two positions, i.e., a capping position where the capping device covers the faces of the two recording heads 7 and 8 on which the nozzle openings are found (hereinafter, such a face is referred to as "nozzle opening face"), and a noncapping position where the capping device is separated from the nozzle opening faces. The areas of the cap members 31 and 32 opening towards the recording heads are selected to match the sizes of the respective first and second recording heads 7 and 8.

Figure 3:
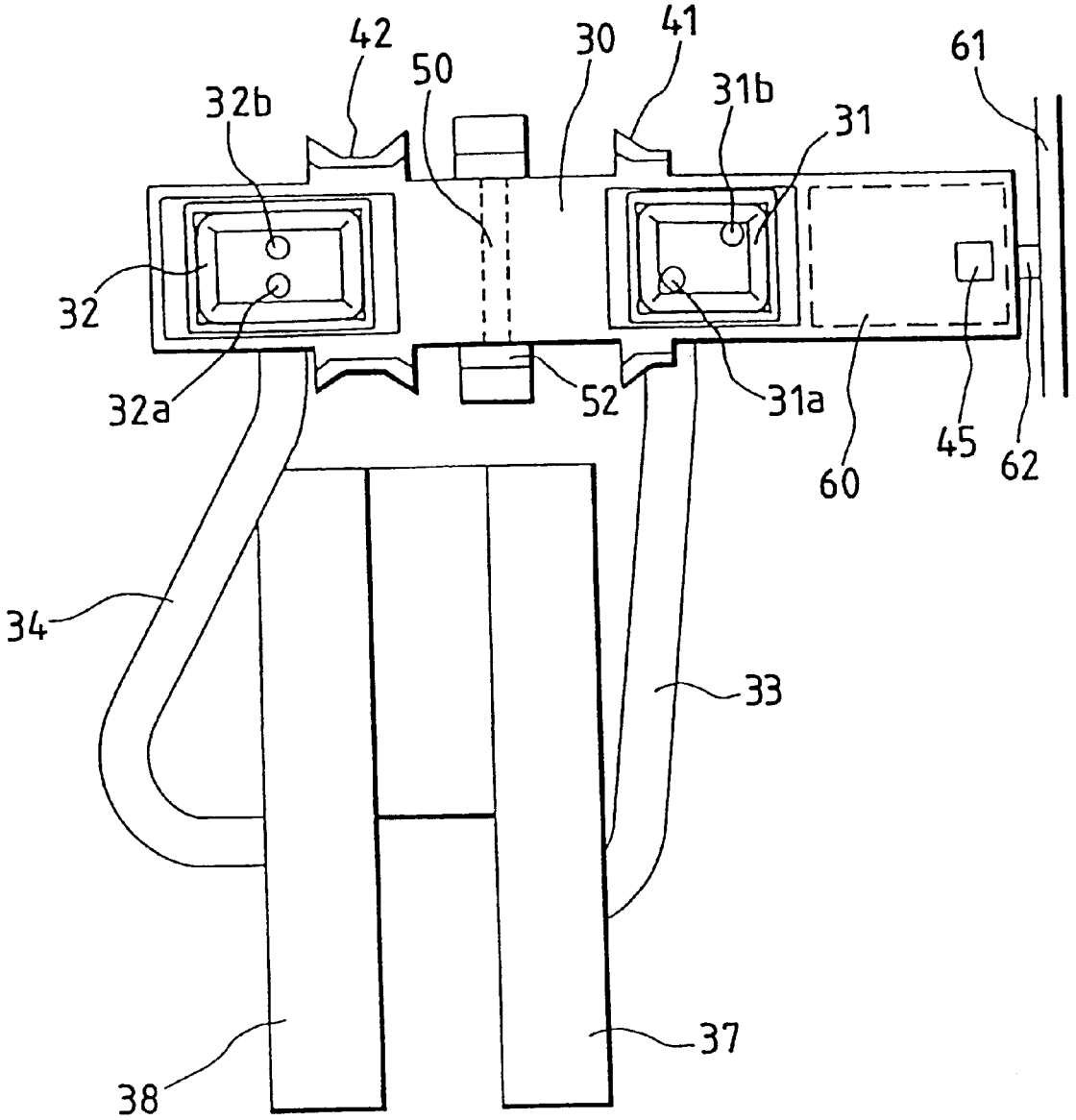
FIG. 3 is a plan view showing an embodiment of the capping device.

As best seen from FIG. 3, the first and second cap members 31 and 32 respectively have suction ports 31*a* and 32*a* which are connected to ends of tubes 33 and 34 constituting parts of first and second tube pumps 37 and 38, so as to be subjected to suction forces produced by the tube pumps 37 and 38. The tube pumps 37 and 38 form part of a pump unit 13 and will be described in greater detail below. The first and second tube pumps 37 and 38 are selectively driven by the sheet feed and pump motor 24 through a wheel train 40 to conduct a suction operation (FIG. 2). More specifically, when the motor 24 is forward rotated, only the first tube pump 37 conducts a suction operation, and, when the motor 24 is reversely rotated, only the second tube pump 38 conducts a suction operation.

Figure 4:
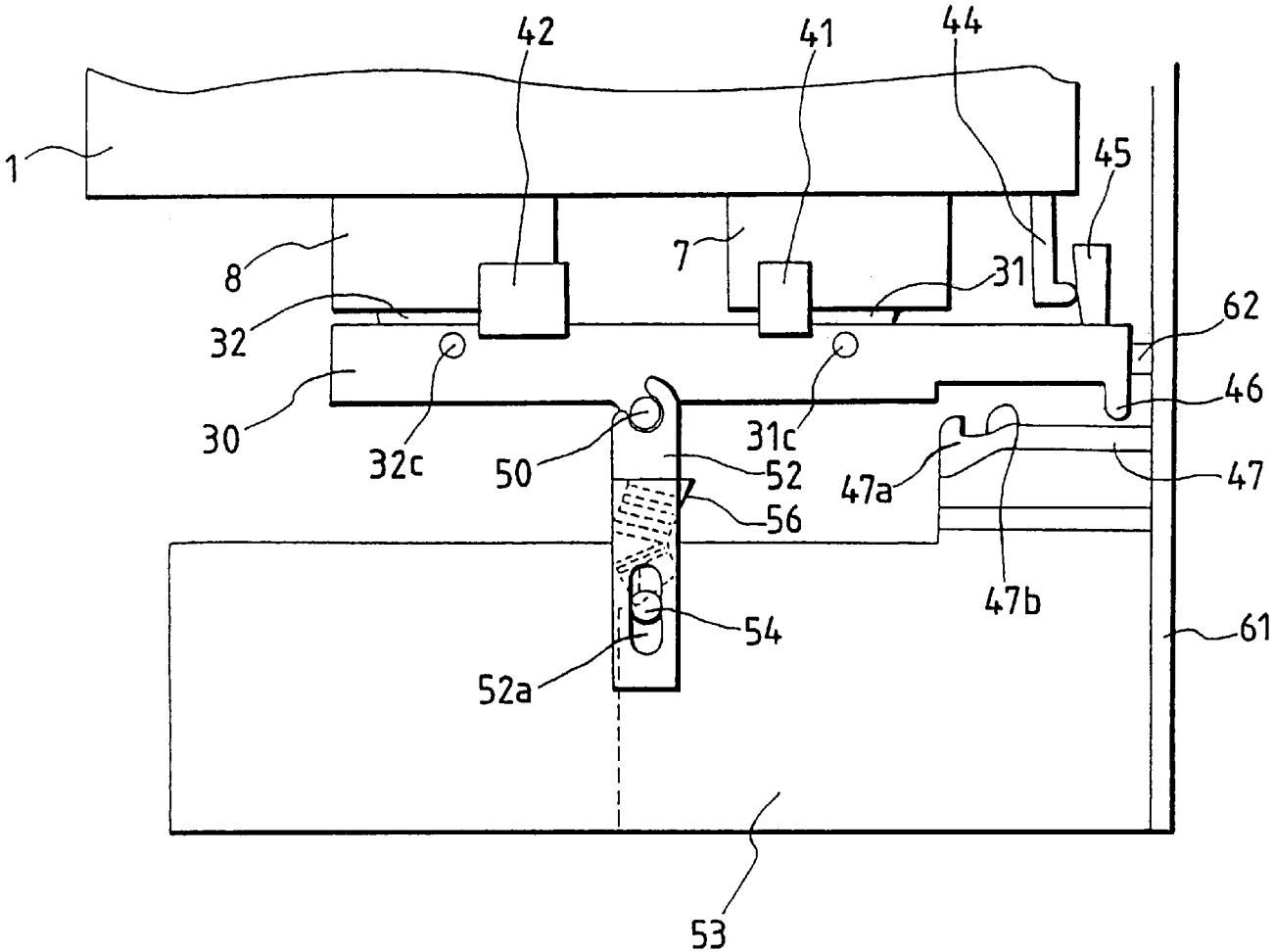
FIG. 4 is a front view showing the embodiment of the capping device in the state where the capping device abuts against the recording heads.

FIGS. 3 and 4 show an embodiment of the above-described capping unit. In the figures, the reference numeral 30 designates the slider which is disposed in such a manner that the first and second cap members 31 and 32 are swingable about shafts 31*c* and 32*c* in correspondence with the distance between the two recording heads 7 and 8 mounted on the carriage 1. In the figures, the reference numerals 41 and 42 designate first and second guide pieces each of which consists of two subpieces that are disposed on opposite sides of the first and second recording heads 7 and 8 mounted on the carriage 1, so as to correspond to the widths of the heads. The first and second guide pieces are separated from each other by a distance so that, when the carriage 1 is set at a predetermined position, they oppose the recording heads 7 and 8, respectively. At one end portion of the slider 30 (the right end portion in the figure), a flagpiece 45 is formed which abuts against a projection 44 protruding from the lower end of the carriage 1 when the carriage 1 is located at the position where the first and second cap members 31 and 32 exactly oppose the respective first and second recording heads 7 and 8. An engaging piece 46 is disposed at a position which is closer to the tip end than the flagpiece 45, so as to make contact with and separate from a guide member 47 fixed to a base.

The guide member 47 comprises a projection 47*a* which prevents the slider 30 from slipping off, and a slant face 47*b* extending between two positions. Usually, the slider 1 is located at one of the positions so as to be separated from the lower ends of the recording heads 7 and 8 by a given distance. In a capping period, the slider 1 is located at the other position where the cap members 31 and 32 are brought into resilient contact with the recording heads 7 and 8.

A shaft 50 extending in a direction perpendicular to the moving direction of the carriage 1 is disposed at the center of the lower portion of the slider 30. Both ends, of the shaft 50 are loosely fitted into levers 52. The lower end of the lever is swingably attached to a shaft 54 of the base 53 through a slot 52*a*. An upper end of a coil spring 56 which buckles slightly toward the nonprinting region is attached to the slider 30. The lower end of the coil spring 56 is fixed to the base 53, and inclined toward the printing region.

Figure 9:
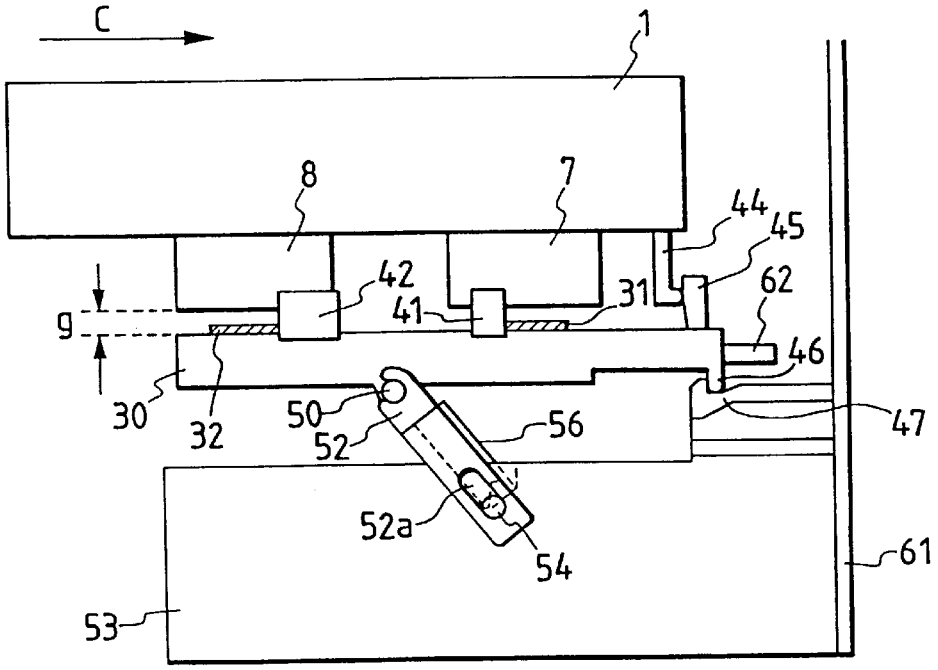
FIG. 9 is a diagram showing the state where a carriage is moved to a position where recording heads oppose respective cap members without contacting them.

According to this configuration, during a noncapping period, the slider 30 is urged toward the printing region by the coil spring 56 while one end of the slider is restricted by the lowest end of the slant face 47*b* of the guide member 47, and the center portion by the lever 52, so as to be horizontally positioned at a height where a gap g is formed that is of sufficient size for separating the recording heads 7 and 8 from the respective cap members 31 and 32 (FIG. 9).

As shown in FIG. 3, the slider 30 has a valve unit 60 disposed at a position in the side of a case 61. The valve unit 60 communicates with air release ports 31*b* and 32*b* formed in the respective cap members 31 and 32. An operation rod 62 protrudes from the valve unit 60. When the slider 30 is moved to the capping position and the operation rod 62 abuts against the case 61, the operation rod 62 is pressed toward the printing region so that the air release ports 31*b* and 32*b* are closed by the valve unit 60.

Figure 5:
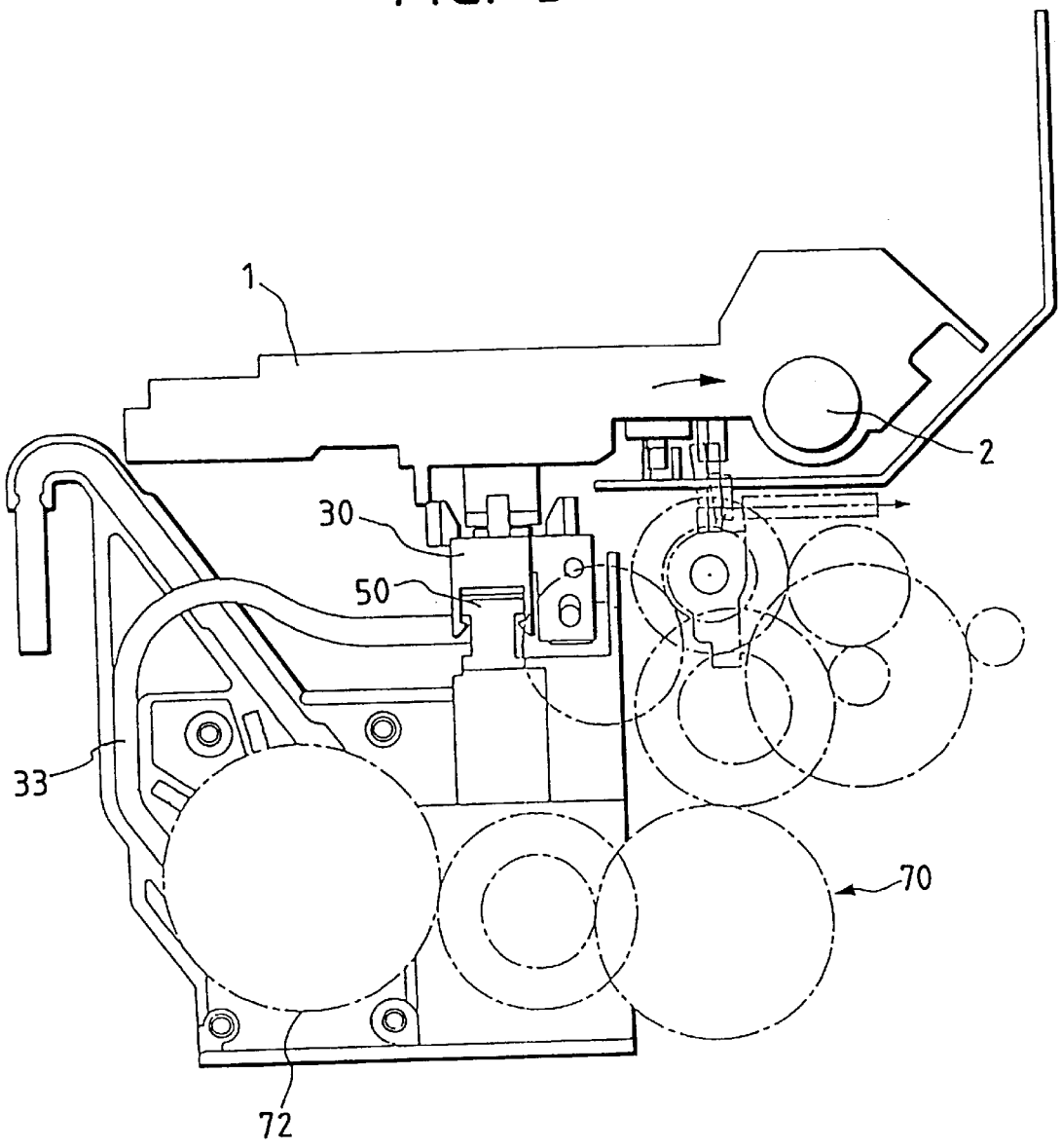
FIG. 5 is a diagram showing the state where a sheet feed and pump motor is coupled with a tube pump.
Figure 6:
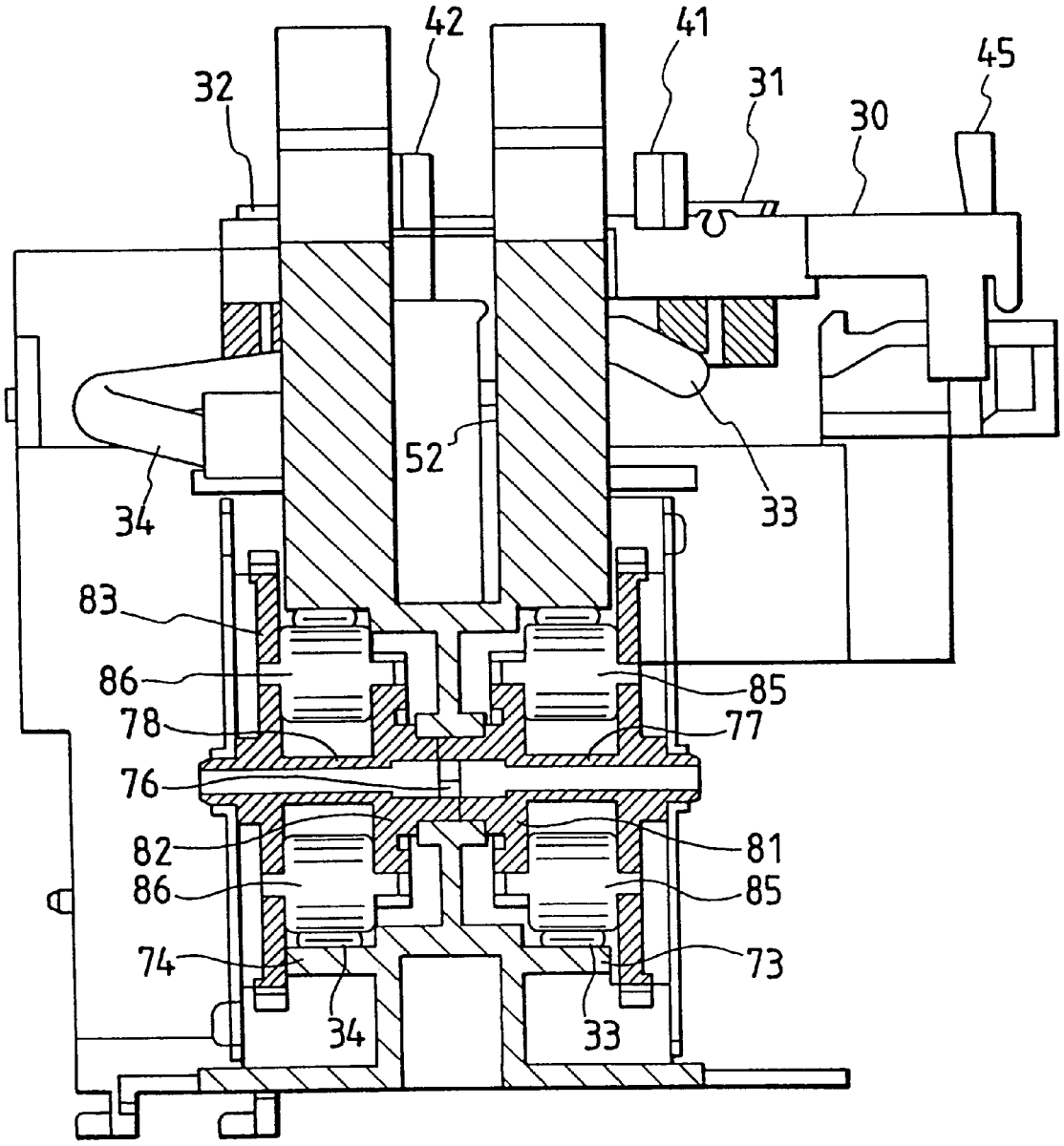
FIG. 6 is a diagram showing the structure of a longitudinal section of the tube pump.
Figure 7:
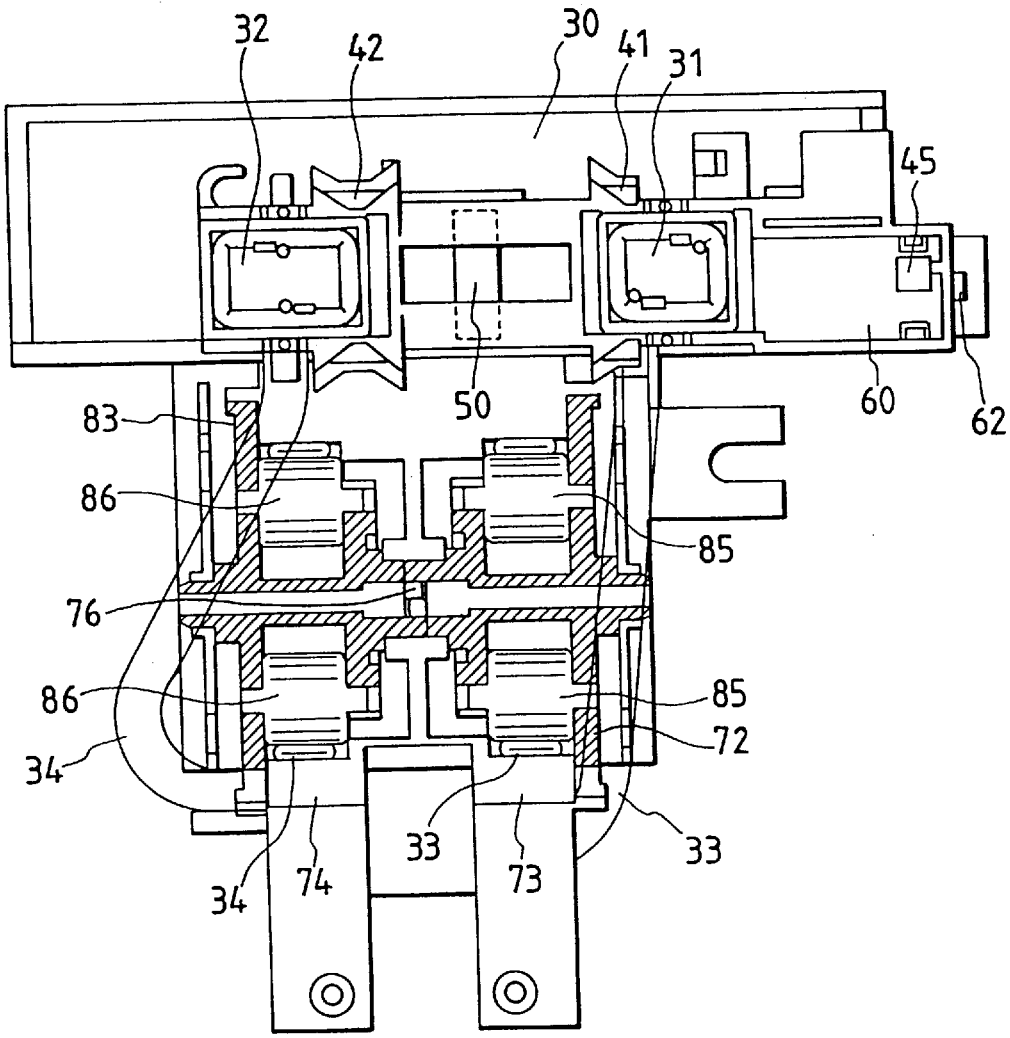
FIG. 7 is a diagram showing the structure of a cross section of the tube pump.

FIGS. 5, 6 and 7 show an embodiment of the above-mentioned pump units 13. A driving wheel 72 of the one pump 37 can be coupled with the sheet feed and pump motor 24 through a wheel train 70. The pump tubes 33 and 34 through which the cap members 31 and 32 communicate with a waste ink tank 14 are covered by cover cases 73 and 74, respectively, so that the outer side of each tube is formed into a substantially circular shape. Each of the pump tubes 33 and 34 can be resiliently pressed by two rollers 85 and 85 or 86 and 86 which are movably loosely fitted into slots formed in a train of driving wheels 72, 81, 82 and 83 which are fixed to both ends of rotation shafts 77 and 78. The rotation shafts 77 and 78 are coupled to each other through a connecting member 76. The slots will be described later in detail.

Figure 8A:
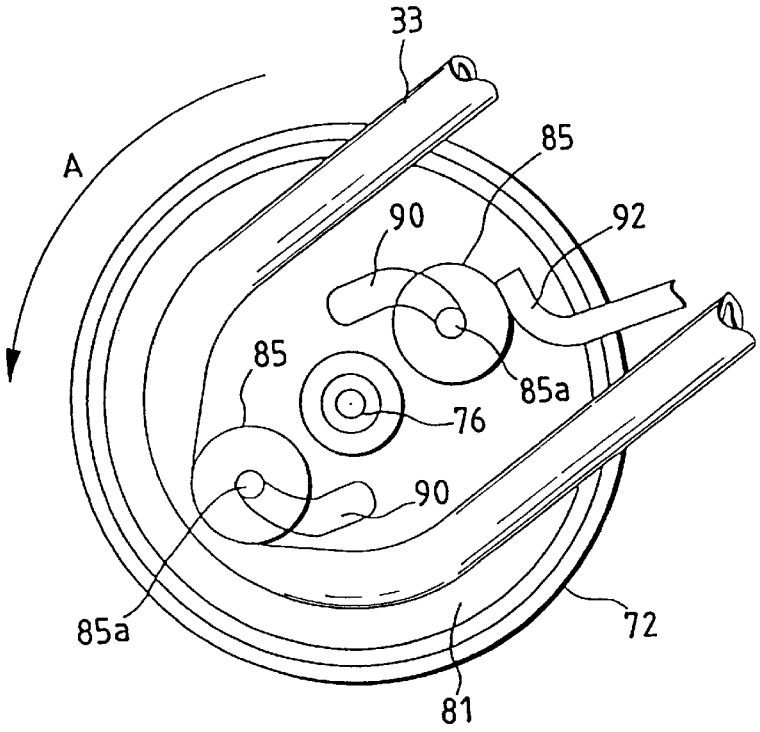
FIGS. 8(*a*) and (*b*) are diagrams showing the shape of slots formed in a driving wheel constituting a first type of tube pump.
Figure 8B:
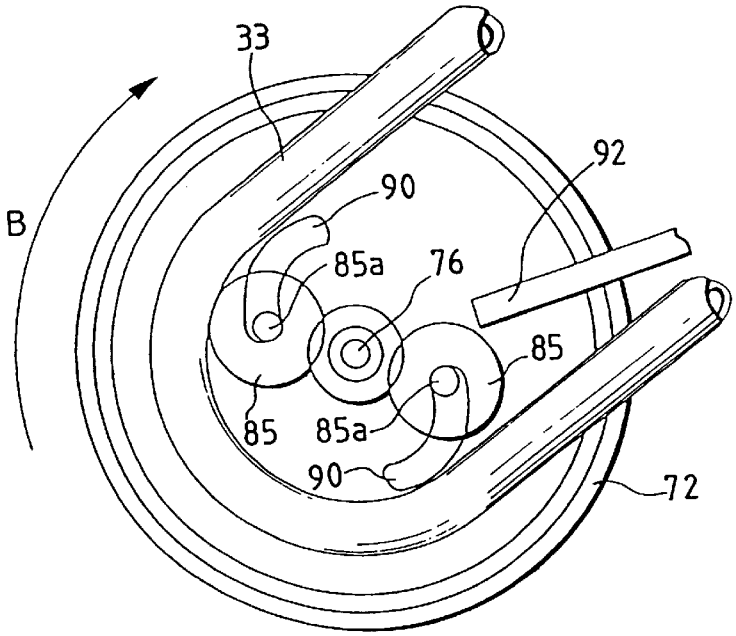

FIGS. 8(*a*) and 8(*b*) show an embodiment of the above-mentioned guide slots 90 which are formed in the driving wheels supporting the rollers 85 and 86. The guide slots 90 are formed as slots, each of which extends in such a manner that the distance between the slot and the center of the respective driving wheel gradually changes. When the sheet feed and pump motor 24 is reversely rotated (arrow A), the shafts 85*a* of the rollers 85 are moved along the respective slots 90 toward the outer periphery. This causes the rollers 85 to be rotated while pressing against the tube 33, thereby generating a suction force. When the motor 24 is forward rotated (arrow B), the shafts 85*a* of are moved toward the center and the rollers 85 are separated from the tube 33 so that the pump operation is discontinued.

The second tube pump 38 is configured so as to operate in a manner opposite to the first tube pump 37. Specifically, when the motor 24 is reversely rotated, the rollers 86 are moved toward the center so that the pump operation ceases, and, when the motor 24 is forward rotated, the rollers 86 are moved toward the outer periphery so as to be rotated while pressing against the tube 34, thereby generating a suction force.

In this way, the pump which is to generate a suction force can be selected by switching the rotation direction of the motor 24. In FIGS. 8(*a*)–(*b*), the reference numeral 92 designates a roller pressing piece which is made of an elastic material such as rubber. When the driving wheel 72 is rotated, the roller pressing piece 92 resiliently presses the rollers 85 so that the rollers 85 are forcedly moved along the respective slots 90 to the position corresponding to the rotation direction of the motor.

The roller pressing piece 92 provides an advantage in absorbing a snap sound when the roller is separated from the tube.

Figure 16:
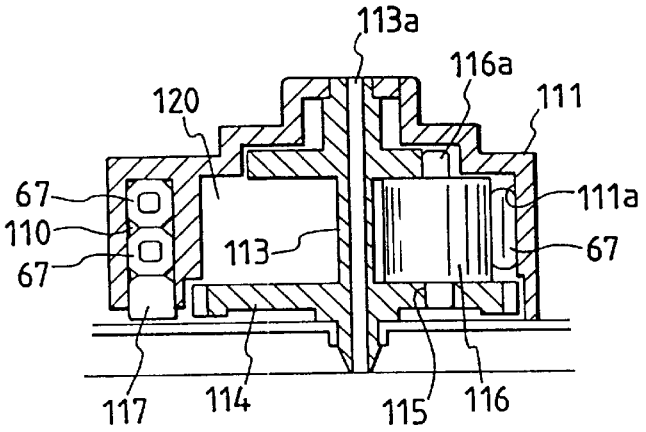
FIG. 16 is a section view showing another embodiment of the tube pump.
Figure 17A:
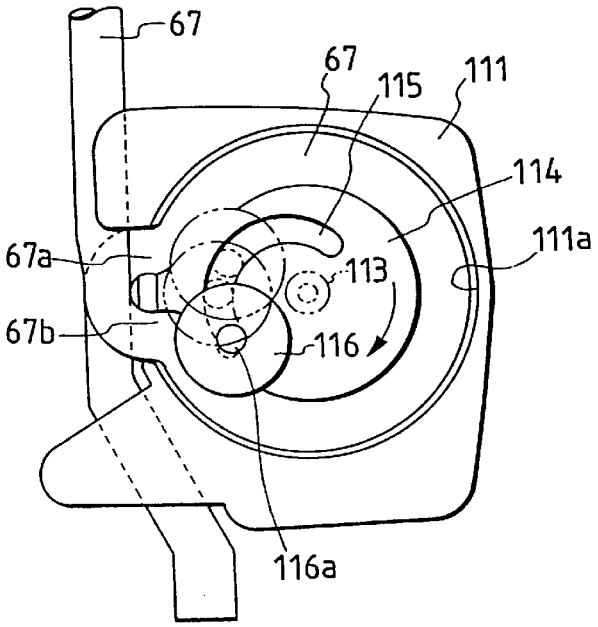
FIGS. 17(*a*) and (*b*) are diagrams illustrating the operation of the tube pump of FIG. 16.
Figure 17B:
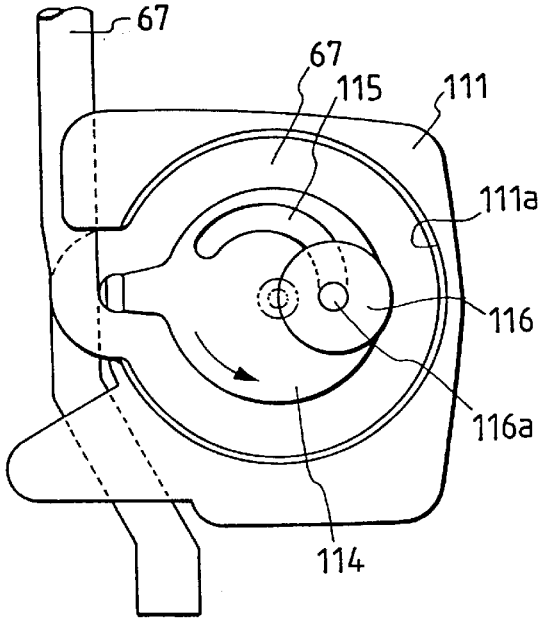

FIGS. 16 and 17 show another embodiment of the above-mentioned pump units 13. In the figures, only the pump unit which communicates with one of the cap members is shown. As shown in the figures, a part of a tube 67 is bent with a large radius of curvature so as to be formed into an α-like shape. The loop portion is inserted into a cover case 111 while the crossing portions pass through a tube insertion hole 110, in such a manner that the resilience of the tube causes the loop portion to make one turn while running along an inner wall face 111*a* of a pump chamber 120. The tube 67 is resiliently pressed by a roller 116 which is movably and loosely fitted into a guide slot 115 of a driving wheel train 114 fixed to a rotation shaft 113. A fixing bush 117 is provided at the crossing portions so that the tube 67 is prevented from slipping off the tube insertion hole 110.

FIGS. 17(*a*) and 17(*b*) are diagrams illustrating the pump unit shown in FIG. 16 in which portions unnecessary in the description are not shown. The guide slot 115 is formed in the driving wheel train 114 as a slot which extends in such a manner that the distance between the slot and the center gradually changes.

When a power exerted by a driving motor, not shown, is transmitted to the tube pump through the driving wheel train 114 so that the tube pump is moved in the direction of the arrow in FIG. 17(*a*), this movement causes the shaft 116*a* of the roller 116 to be moved along the guide slot 115 toward the outer periphery, whereby the roller 116 is rotated while pressing against the tube 67 to generate a suction force. When the pump is rotated in the direction of the arrow shown in FIG. 17(*b*), the shaft 116*a* is moved toward the center and the roller 116 is separated from the tube 67 so that the pump function is discontinued. The tube pump has a configuration in which the roller 116 presses also against portions 67*a* and 67*b* of the tube 67 in the crossing portions, and therefore a continuous pumping operation can be conducted with a single roller. In this embodiment, the snap sound which is made when the roller separates from the tube can be reduced in level by a noise reduction effect achieved by the tube, as arranged along the inner wall face 111*a* of the pump chamber 120. Since a part of a tube is looped so as to form an α-like shape with a small curvature, the tube can be routed without requiring a large curvature even in the case of a small-sized tube pump. This enables a tube of a relatively large diameter to be used, and both suction and discharge tubes to be elongated lengthwise. A friction force generated by tube pressing means at the crossing portions can reliably prevent the tube from working its way out of the pump chamber 20.

The tube pump in the embodiment is coupled with another tube pump which is configured to operate symmetrically, in the same manner as described in the foregoing embodiment. The coupling is located at 113*a* of the rotation shaft 113 and achieved through a connecting member which is not shown. This enables the single driving source to selectively drive the capping means, to conduct suction.

Next, the operation of the apparatus configured as described above will be described.

As shown in FIG. 2, when the carriage 1, on which the two recording heads 7 and 8 are mounted, is moved in a direction indicated by an arrow C in FIG. 9, a lever 102, which can be rotated in the direction of arrow 101 about a shaft 100 disposed at the lower portion of the carriage 1, is caused to contact with a slant face 103 to be rotated. This rotation causes a slide gear 104 to be moved against the resilience of a spring 105, so that the power exerted by the sheet feed and pump motor 24 is transmitted to the pump units 13. The carriage 1 then reaches the slider 30 located outside the printing region, and then the first recording head 7 engages with the second guide 2 disposed on the slider 30. When the carriage 1 is further moved under this state, the first recording head 7 engages with the first guide 41, and the second recording head 8 with the second guide 42, whereby the slider 30 is aligned so as to take a posture corresponding to the carriage 1. When the carriage 1 is further moved under this state, the projection piece 44 disposed at the front end of the carriage 1 abuts against the flagpiece 45 of the slider 30. This results in the first and second cap members 31 and 32 of the slider 30 opposing the respective first and second recording heads 7 and 8 of the carriage 1 while being separated therefrom by the fixed gap g. The respective positioning is such that the cap members can accommodate the respective recording heads 7 and 8.

When the carriage 1 is further moved under this state, the carriage 1 applies a force to the flagpiece 45 of the slider 30 via the projection 44 of the carriage 1. The lever 52, which is subjected to the urging force of the coil spring 56, which buckles slightly at its upper portion in the moving direction of the carriage 1, applies a resistance force to the slider 30. Therefore, the slider 30 inclines forward so that a force is exerted to lift up the rear end of the slider 30 as indicted by an arrow D in FIG. 10.

Figure 10:
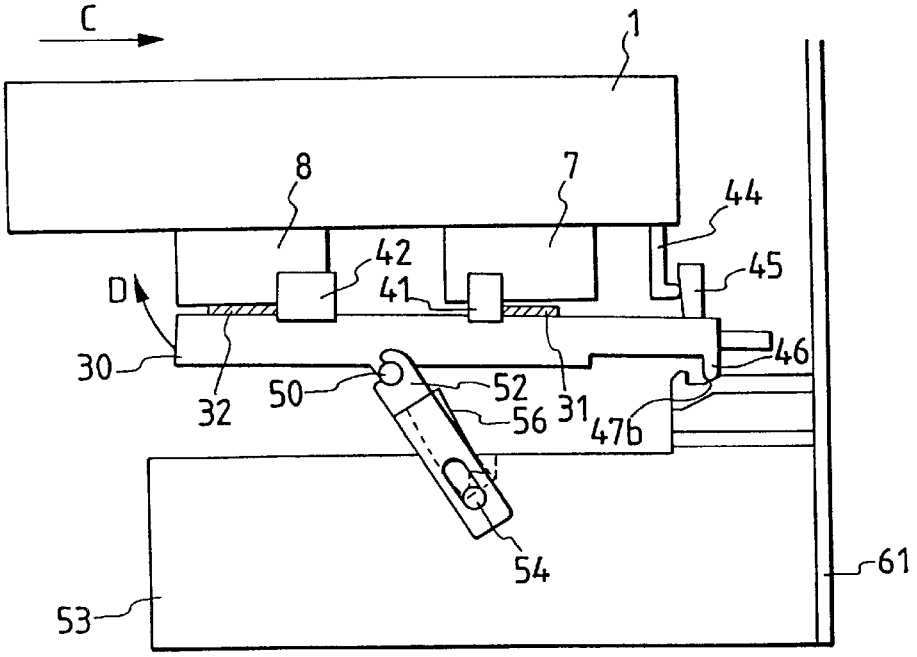
FIG. 10 is a diagram showing the state where the carriage is moved to a position where one of the recording heads abuts against one of the cap members.

As a result, the rear portion of the slider 30 is lifted up while the shaft 50 functions as the rotation fulcrum, so that the second cap member 32 which is located at a more rearward position than the shaft 50 (in the side of the printing region) abuts first against the second recording head 8. At this time, since the cap member 32 is attached to the slider 30 in a slightly swingable manner and the slider 30 is swingably attached to the base 53 through the lever 52, the cap member 32 is lifted up while being guided by the second recording head 8 and then abuts against the second recording head 8 at a position where the cap member can seal the head (FIG. 10).

Figure 11:
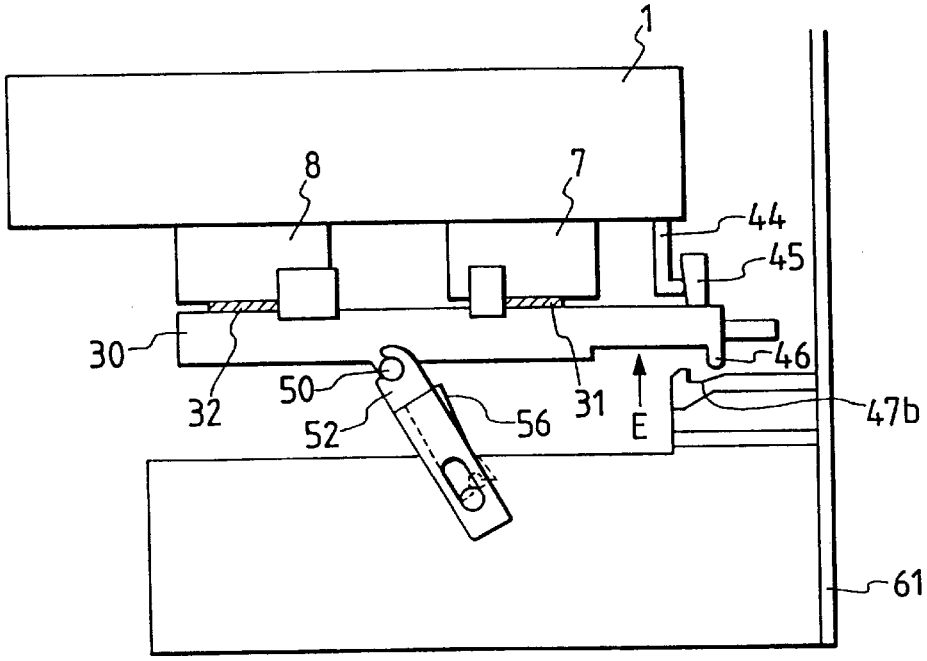
FIG. 11 is a diagram showing the state where the carriage is moved to a position where the two recording heads abuts against the two cap members.

When the carriage 1 is further moved toward the case 61, it becomes impossible for the coil spring 56 to resist the force exerted by the carriage 1, and begins to buckle so that the slider 30 is lifted up (as indicated by an arrow E in FIG. 11). This causes the portion of the slider 30 on the side of the case 61 to be lifted up while maintaining the state where the second cap member 32 is fitted into the second recording head 8, with the result that the first cap member 31 is fitted into the first recording head 7. Since the slider 30 swings with respect to the base 53 and the first and second cap members 31 and 32 are somewhat swingable with respect to the slider 30 and configured by an elastic member, naturally, the cap members 31 and 32 are guided by the edges of the recording heads 7 and 8 into the recording heads 7 and 8, respectively (FIG. 11).

When the carriage 1 is further moved in this way, the slider 30 is horizontally moved toward the case 61 while the upper face of the slider is restricted by the recording heads 7 and 8. Then, the operation rod 62 protruding from the front end of the slider 30 abuts against the case 61 to be pressed in the direction of an arrow K in FIG. 12 so as to isolate the air release ports 31*b* and 32*b* of the cap members 31 and 32 from the air.

Figure 12:
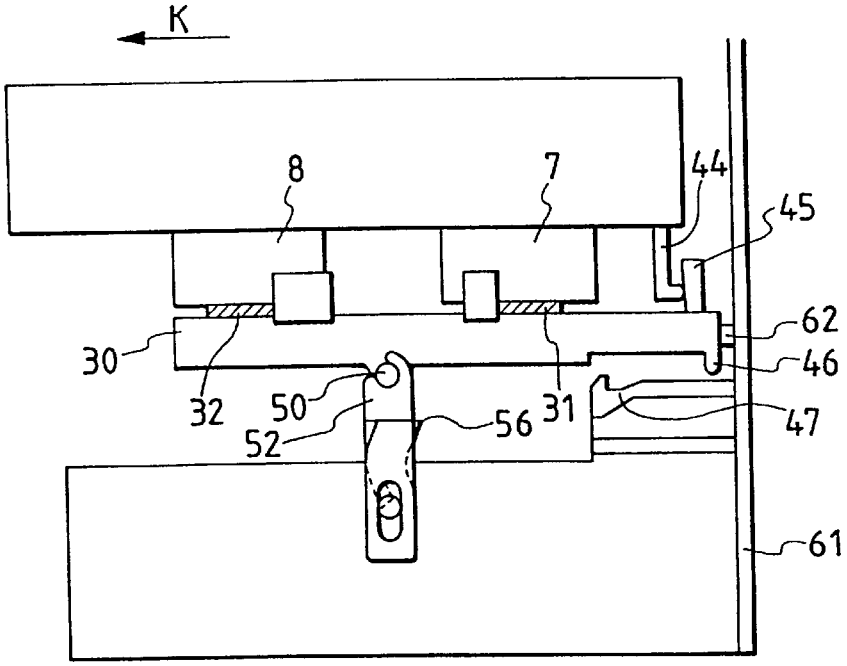
FIG. 12 is a diagram showing the state where the carriage is moved to a suction enabled position.

Under this state, since the coil spring 56 buckles substantially, the slider 30 is lifted up by the resilient force of the coil spring 56. Consequently, the cap members 31 and 32 resiliently contact the recording heads 7 and 8 to securely seal them (FIG. 12).

Under the state where the cap members 31 and 32 resiliently contact the recording heads 7 and 8, as described above, the sheet feed and pump motor 24 couples with the driving wheel 72 of the tube pump 37 through the lever 102. When the motor 24 is reversely rotated, therefore, the first tube pump 37, and the second tube pump 38 connected thereto through the connecting member 76 are rotated. The rotation of the driving wheel 72 in the direction indicated by arrow F in FIG. 13 causes the rollers 85 to be guided by the slots 90 and moved toward the outer periphery so as to make resiliently contact the tube 33, and hence the first tube pump 37 starts the suction operation (FIG. 13(*a*)).

Figure 13A:
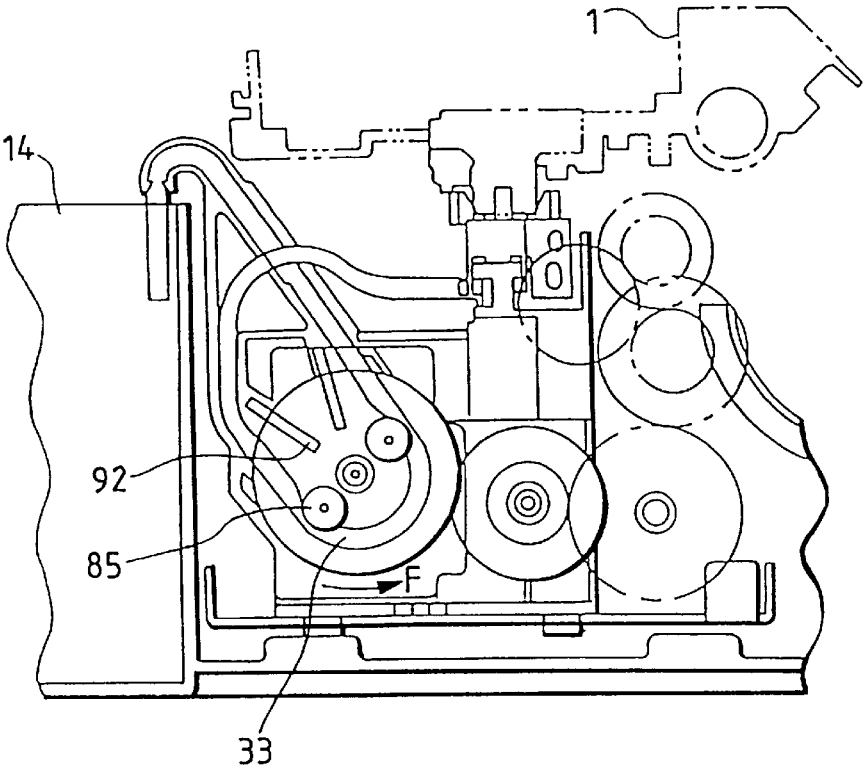
FIGS. 13(*a*) and 13(*b*) are diagrams respectively showing the states of first and second tube pumps in the case where the sheet feed and pump motor is reversely rotated.
Figure 13B:
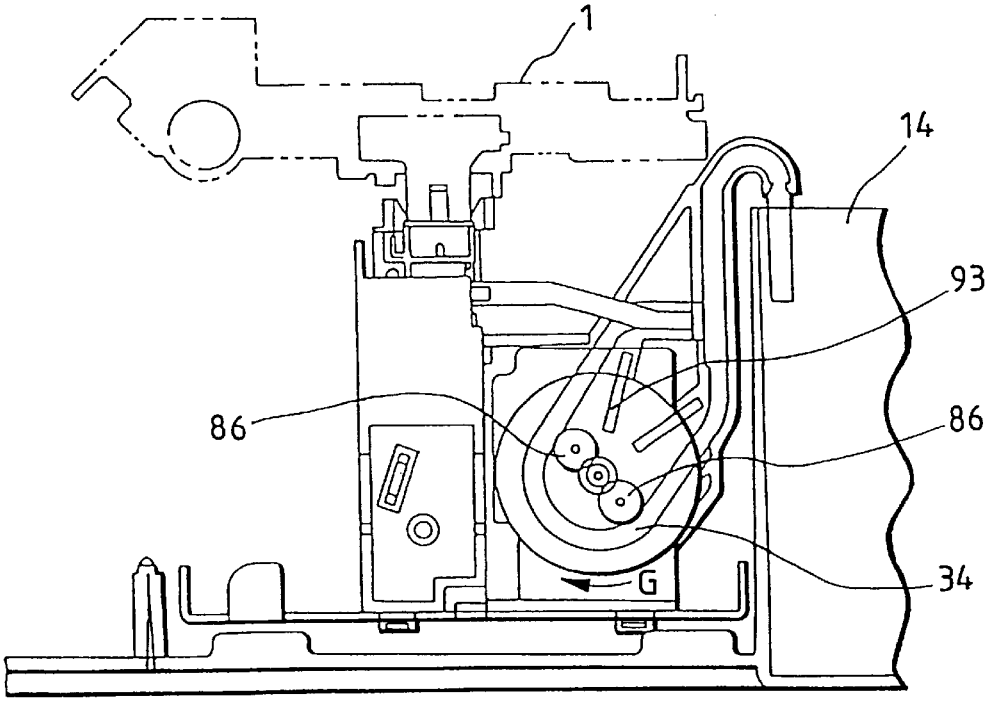

On the other hand, in the second tube pump 38, the rollers 86 are moved toward the center by the rotation of the driving wheel in the direction indicated by arrow G, and rotated in a substantially idling manner at positions where the rollers do not resiliently press the tube 34 (FIG. 13(*b*)). Therefore, only the first cap member 31 is subjected to a suction force so that the first recording head 7 sucks ink. Ink ejected from the first recording head 7 into the cap member 31 is discharged through the tube 33 into a waste ink tank 14.

Figure 14A:
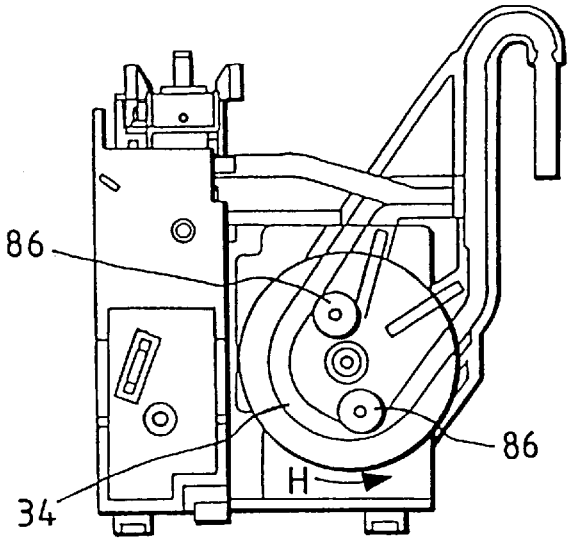
FIGS. 14(*a*) and 14(*b*) are diagrams respectively showing the states of second and first tube pumps in the case where the sheet feed and pump motor is forward rotated.
Figure 14B:
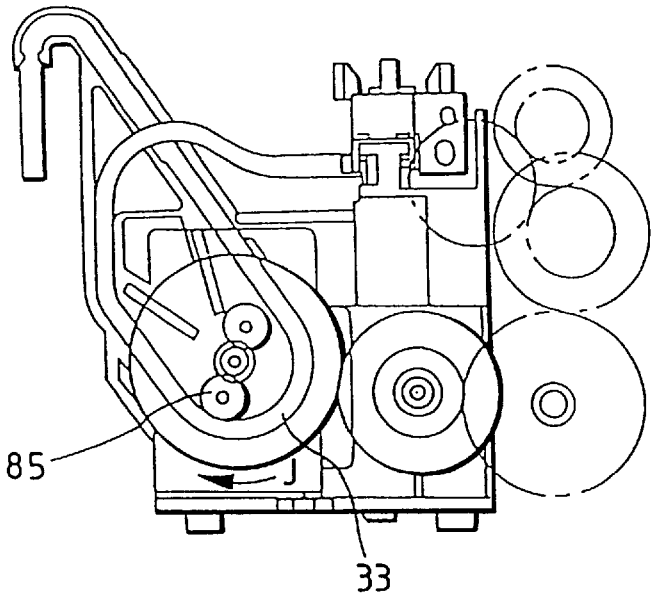

When the ink suction of the first recording head 7 conducted as described above is completed, the motor 24 is forward rotated so that, in the second tube pump 38, the driving wheel for the pump is rotated in the direction indicated by arrow H, whereby the rollers 86 are moved toward the outer side to resiliently contact the tube 34 (FIG. 14(*a*)). In the first tube pump 37, the driving wheel is rotated in the direction indicated by arrow J in FIG. 14(*b*) and the rollers 85 are moved toward the center so as to be located at positions where they do not resiliently press the tube 33 (FIG. 14(*b*)). This causes the second cap member 32 to suck ink from the recording head 8. Ink ejected into the second cap member 32 is discharged through the tube 34 into the waste ink tank 14.

Only one of the recording heads 7 and 8 from which ink is to be sucked can be subjected to ink suction at a time, by selecting the rotation direction of the sheet feed and pump motor 24. Therefore, the other recording head from which ink i not to be sucked is prevented from being subjected to ink suction. Moreover, it is possible to use a motor of small rating, producing a torque which is just sufficient enough for driving only one pump.

Figure 15A:
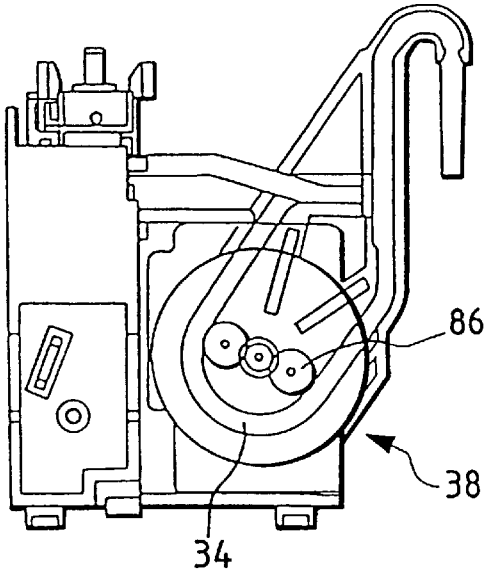
FIGS. 15(*a*) and 15(*b*) are diagrams respectively showing the states of second and first tube pumps in the case where the sheet feed and pump motor is stopped.
Figure 15B:
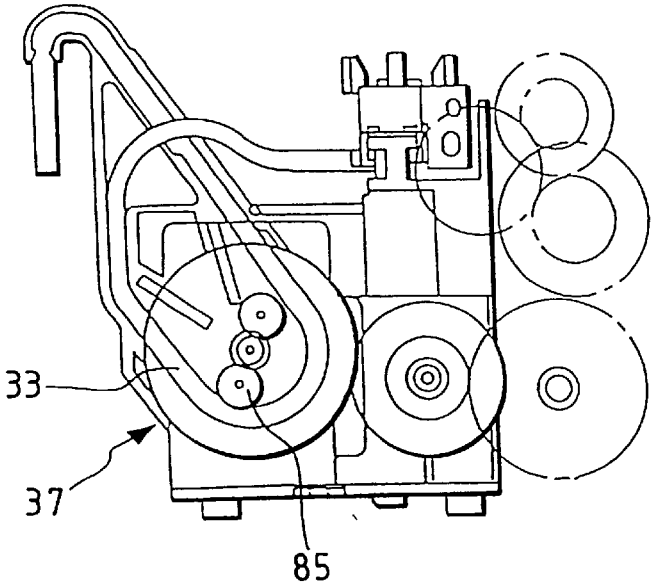

When the suction operation is completed, the driving wheels 72 and 83 are rotated by about 60 to 150 deg. in a direction which is opposite to the suction force generating direction of the pump that was just operated (in the embodiment, the second tube pump 38). By the tube 33 and the roller pressing piece 92, irrespective of the positions of the rollers 85 of the first pump 37 when the rotation angle is 150 deg. or less, the rollers 85 are prevented from moving over a roller pressing piece 92 for resiliently pressing the tube 33. When the rotation angle is 60 deg. or more, the shape of the slots 90 causes the rollers 86, which have resiliently pressed the tube 34 of the second pump 38, to be moved to positions where they do not resiliently press the tube 34. As a result, the first and second tube pumps 37 and 38 enter the stop state at positions where the rollers 85 and 86 do not resiliently press the respective tubes 33 and 34 (FIGS. 15(*a*) and 15(*b*)). This enables the first and second cap members 31 and 32 to communicate with the air through the respective tubes 33 and 34 which constitute the pumps, so that a printing failure of the recording heads which may be caused by variation in atmospheric pressure due to changes in temperature is prevented from occurring. Furthermore, the tubes are prevented from being compressed for a long time by the rollers 85 and 86.

When a series of operations is completed and no further data to be printed exists, the apparatus is transferred to an inactive state and this state is maintained. In contrast, when the printing is to be continued, the carriage 1 is moved in the direction of arrow K in FIG. 12. Since the first and second cap members 31 and 32 are fitted into the recording heads 7 and 8, the slider 30 follows the movement of the carriage 1 moving in the direction of the arrow K. When the slider 30 is moved as described above and the projection 46 of the slider 30 reaches the lowest area of the slant face 47*b* of the guide member 47 (FIG. 9), the slider 30 is urged by the coil spring 56 to be lowered, and becomes horizontal. This produces the gap g between the recording heads 7 and 8 and the slider 30 so that the carriage can move freely in the main scanning direction. Consequently, the recording heads are moved, as they are to the printing region and then execute the printing operation in accordance with printing data. Under this state, the engaging piece 46 of the slider 30 engages with the projection 47*a* of the guide member 47, and hence the slider 30 can remain positioned at a predetermined location.

A suction operation other than the above-described suction operation will be described.

Figure 18:
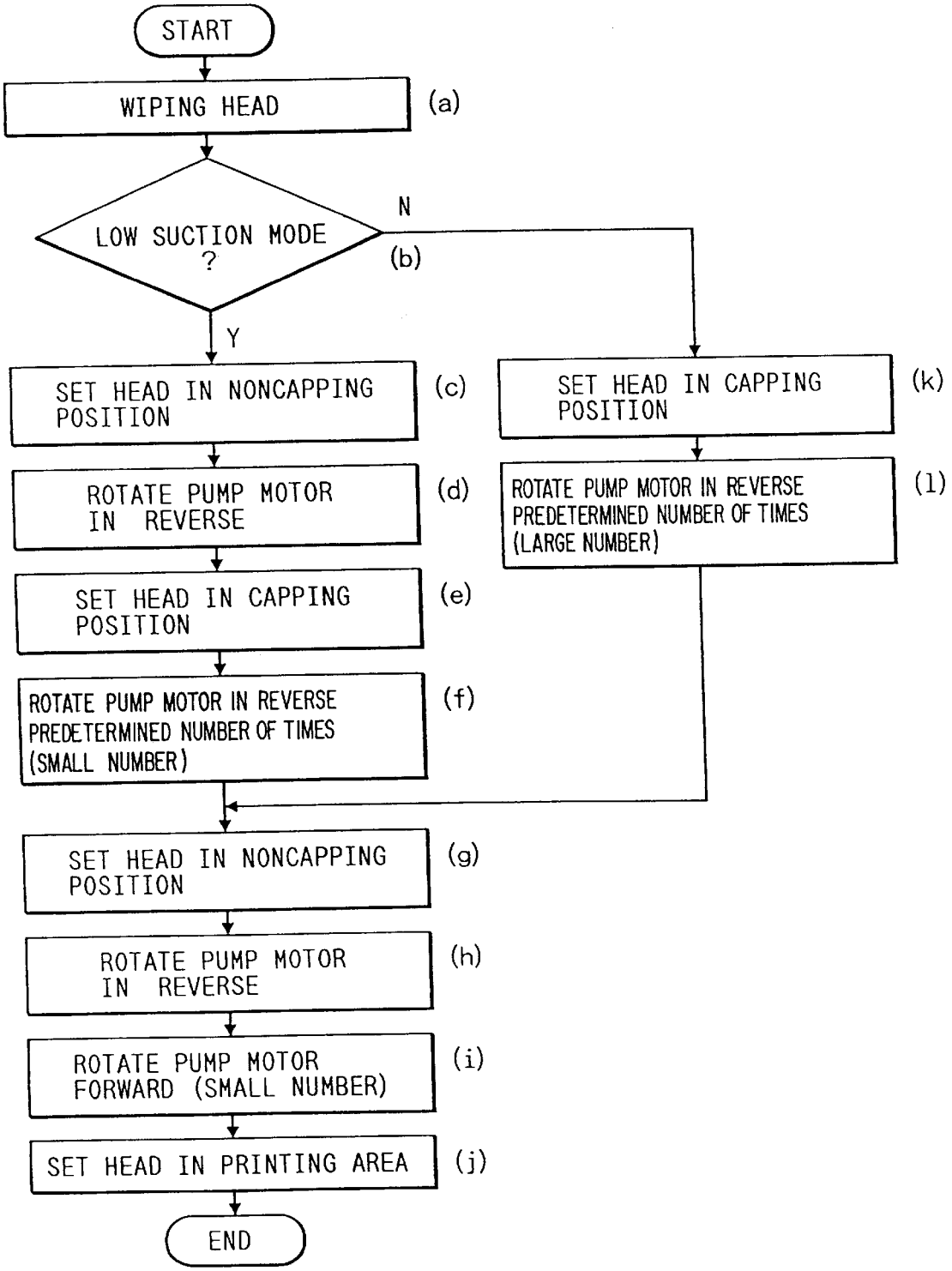
FIG. 18 is a chart illustrating the process in a low suction mode.
Figure 19:
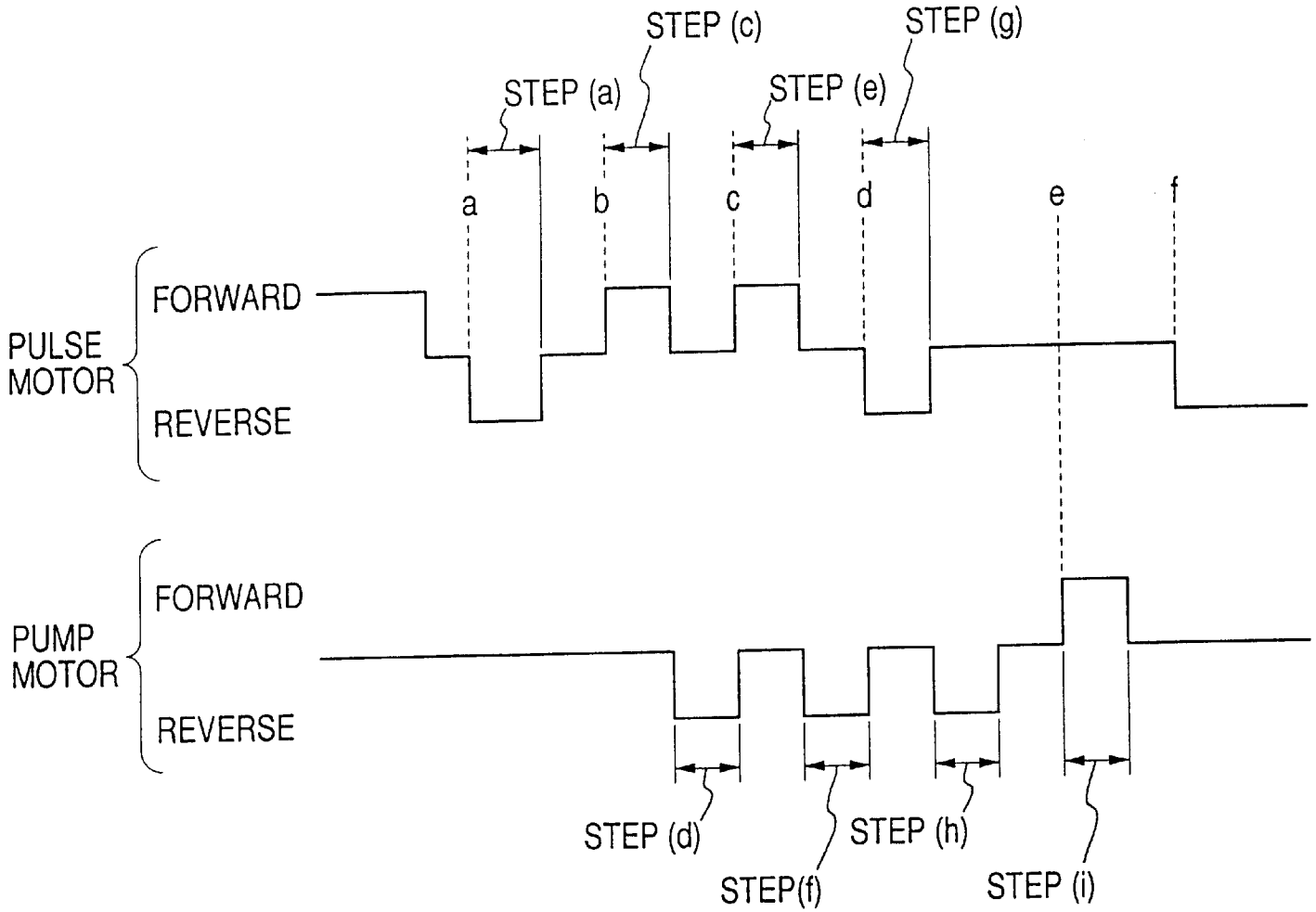
FIG. 19 is a chart illustrating the rotation directions of a pulse motor and a pump motor in a low suction mode.

This suction operation is a very effective method of precisely controlling the amount of the ink to be sucked (low suction mode). This operation will be described in detail with reference to FIGS. 18 and 19.

Although the following description is directed only to the operation conducted on the first recording head, the operation on the second recording head can be conducted in the same manner.

A controller which is not shown controls the pulse motor so that it forward rotates, whereby the recording head 7 is moved to the capping position for the capping device 12 which is located in the nonprinting region. The pulse motor is reversely rotated at time a so that the recording head 7 is moved to a wiping position and the face of the recording head is wiped by a wiper which is not shown (step a). The wiper is arranged in the vicinity of the capping device on the side closer to the printing region.

After the wiping process, the pulse motor is forward rotated slightly at time b so that the recording head 7 is moved to the noncapping position, which is located between the capping and wiping positions. The cap member is set to a noncapping state (step c). Under this state, the pump motor 24 is reversely rotated and the driving wheel 72 is rotated in the direction indicated by arrow F in FIG. 13. The rollers 85 are placed from the tube nonpressurizing state into the tube pressurizing state, and the condition in which ink suction is enabled is established (step d).

Thereafter, the pulse motor 23 is again forward rotated at time c, and the recording head 7 is moved to the capping position (step e). Under this state, the pump motor 24 rotates a predetermined number of turns so that the driving wheel 72 turns a sufficient number of times for introducing fresh ink into the nozzles, using the ink suction enabled state as a reference. A negative pressure is generated in the tube so that fresh ink is introduced into the nozzles, thereby removing clogging ink (step f).

After this ink suction operation, the pulse motor 23 is reversely rotated at time d, and the recording head 7, is returned to the noncapping position (step g). Under this state, the pump motor 24 is reversely rotated so that ink and air in the tube 33 are discharged into the waste ink tank 14 (step h).

Then, the pump motor 24 is slightly rotated at time e, and the rollers 85 change from the tube pressurizing state to the tube nonpressurizing state, i.e., returned to a pump release state (step i). Thereafter, the recording head 7 is moved at time f to the printing region (step j).

As a result of the steps described above, the regeneration of the first recording head 7 is completed. When the second recording head is then to be regenerated, the regeneration can be conducted in the same manner by rotating the pump motor 24 in the opposite direction. In the steps of regenerating the first or second recording head, naturally, the suction step is not conducted on a head which is not required to be regenerated.

When the suction process is conducted according to the steps described above, it is possible to control the ink suction amount in the head regenerating process, so that ink consumption is reduced to a level as low as possible.

In the embodiments described above, the capping position designates a state where a recording head and a cap are in close contact with each other. The noncapping position designates a state where the recording head and the cap are separated from each other.

In another embodiment, a cap is provided with a valve mechanism through which the cap can selectively communicate or not communicate with the air. The same states as the capping and noncapping positions of the above-mentioned embodiments can be attained by the valve mechanism. The same operations as those of the above-mentioned embodiments can be realized under a state where the cap abuts against the recording head. In this case, the capping position is attained by sealing the cap from the air and the non-capping position is attained by communicating with the air.

In the above, embodiments in which nozzle openings of recording heads are directed downward have been described.

It is a matter of course that, even in the case where nozzle openings of recording heads are directed upward or horizontally, the same effects can be attained by disposing caps so as to correspond to the arrangement of the recording heads or take a posture wherein the caps oppose the nozzle opening faces.

Although embodiments in which the invention is applied to a color printer have been described, it is a matter of course that the same effects can be attained even when the invention is applied to a printer in which two ink jet recording heads ejecting drops of ink of the same color are mounted on one carriage so as to improve the recording density.

As described above, according to the invention, the apparatus includes a carriage on which first and second ink jet recording heads having nozzle openings are mounted. It further includes a slider having first and second cap members which seal the nozzle openings of the first and second ink jet recording heads, respectively. The slider is supported at the center portion in a longitudinal direction by a support member which is rotatable about a rotation shaft elongated in a direction perpendicular to the moving direction of the carriage and which is movable in the moving direction of the carriage. The support member is movable also in a direction opposing the recording heads in accordance with the movement of the slider. When the carriage is moved under the state where the carriage abuts against the slider, therefore, the slider swings about the shaft in a manner similar to a seesaw to abut against one of the recording heads, and then abuts against the other recording head. Therefore, the two cap members on the single slider can be attached securely to the respective recording heads. Furthermore, the two cap members are moved by moving the single slider in a manner interlocked with the movement of the carriage, and hence the attaching and detaching mechanism for the cap members can be simplified in structure.

What is claimed:

1. A tube pump for an ink jet recording apparatus comprising:

a driving wheel coupled with a rotation drive source and selectively driven, in accordance with a rotation direction of the drive source, in a first direction or in a second direction, wherein said driving wheel comprises at least two slots, each of said slots extending symmetrically to one another with respect to a radial center of said driving wheel from a radially innermost end of the slot to a radially outermost end of the slot;

at least two rollers shiftably fixed to said drive wheel by means of roller shafts extending from a radial center of each said roller into a respective one of the slots; and a roller pressing piece arranged to contact with the rollers, wherein said pressing piece forces said rollers into the radially outermost end of the slots, to thereby press a tube of said tube pump, when said drive wheel rotates in the first direction, and wherein said pressing piece forces said rollers into the radially innermost end of the slots, to thereby exert substantially no pressing force on the tube, when said drive wheel rotates in the second direction.

2. A tube pump for an ink jet recording apparatus, comprising:

a pump chamber, a part of which is open so as to provide an insertion port for a tube; and a driving wheel train having a single roller cooperating with an inner wall face of the pump chamber to press the tube, the driving wheel train being rotated about a shaft portion of the pump chamber, wherein the tube has a loop portion, the loop portion being formed by crossing portions of the tube to produce an α-like shape, and the loop portion being inserted into the pump chamber to be disposed along the inner wall face of the pump chamber, and wherein a guide slot is formed in the driving wheel train, and the roller is transferred by the guide slot between a tube pressurizing state and a tube nonpressurizing state in accordance with a rotation direction of the driving wheel train.

* * * * *